US010247000B2

(12) United States Patent
Miao

(10) Patent No.: US 10,247,000 B2
(45) Date of Patent: Apr. 2, 2019

(54) KNIFE HOLDER AND BASE SYSTEM FOR MILLING MACHINE

(71) Applicant: KAITO (SUZHOU) CONSTRUCTION MACHINERY CO., LTD, Suzhou (CN)

(72) Inventor: Xiang Miao, Suzhou (CN)

(73) Assignee: KAITO (SUZHOU) CONSTRUCTION MACHINERY CO., LTD, Suzhou (CN)

( * ) Notice: Subject to any disclaimer, the term of this patent is extended or adjusted under 35 U.S.C. 154(b) by 136 days.

(21) Appl. No.: 15/364,351

(22) Filed: Nov. 30, 2016

(65) Prior Publication Data

US 2017/0095943 A1 Apr. 6, 2017

Related U.S. Application Data

(63) Continuation of application No. PCT/CN2015/099815, filed on Dec. 30, 2015.

(30) Foreign Application Priority Data

Aug. 18, 2015 (CN) ..... 2015 1 0508626

(51) Int. Cl.

| | |
|---|---|
| ***E21C 35/18*** | (2006.01) |
| ***E21C 35/19*** | (2006.01) |
| ***E01C 23/088*** | (2006.01) |
| ***B28D 1/18*** | (2006.01) |

(52) U.S. Cl.

CPC ..... *E21C 35/19* (2013.01); *B28D 1/186* (2013.01); *E01C 23/088* (2013.01); *E21C 35/18* (2013.01)

(58) Field of Classification Search

CPC ..... E21C 35/19

See application file for complete search history.

(56) References Cited

U.S. PATENT DOCUMENTS

| | | | | |
|---|---|---|---|---|
| 3,405,595 | A * | 10/1968 | Peterson | F16B 23/00 411/373 |
| 4,542,943 | A * | 9/1985 | Montgomery, Jr. | E02F 9/2866 299/102 |
| 7,086,704 | B2 * | 8/2006 | Holl | E21C 35/193 299/102 |
| 2013/0207444 | A1 * | 8/2013 | Chiang | E21C 35/193 299/104 |

* cited by examiner

*Primary Examiner* — Janine M Kreck
(74) *Attorney, Agent, or Firm* — W&K IP

(57) ABSTRACT

The present invention discloses a knife holder and base system for milling machine. The knife holder and base system comprises a knife holder provided with a fixed part and a base provided with an inner hole; and the fixed part penetrates the inner hole and is matched with a thread in the fixed part through a bolt to be used, so that the knife holder is fixedly connected with the base. According to the knife holder and base system for the milling machine, after the knife holder of the system structure is inserted in the base, more than two V-shaped faying surfaces and the V-shaped supporting surface serve as transition, the knife holder and the base are tensioned through the tensioning bolt, so that the knife holder and base system is of an integrated structure, and the cutting stress of a knife is transmitted into the base better through the knife holder.

6 Claims, 13 Drawing Sheets

KNIFE HOLDER AND BASE SYSTEM FOR MILLING MACHINE

CROSS-REFERENCE TO RELATED APPLICATIONS

This application is a continuation of International Patent Application No. PCT/CN2015/099815 with a filing date of Dec. 30, 2015, designating the United States, now pending, and further claims priority to Chinese Patent Application No. 201510508626.8 with a filing date of Aug. 18, 2015, including any intervening amendments thereto, are incorporated herein by reference.

TECHNICAL FIELD

The present invention relates to a milling machine, in particular to a knife holder and base system for a milling machine, and belongs to the field of machinery.

BACKGROUND OF THE PRESENT INVENTION

A road surface milling machine is a maintenance machine for removing road surface diseases. A knife holder and base system on a milling machine is a milling device where a plurality of knife holders are installed on a base body to be welded to a milling roller. The milling device needs to be replaced when working to a limit value. Due to a large replacement number, high cost and difficulty in replacement, an optimized knife holder and base system which has a longer service life, is required.

SUMMARY OF PRESENT INVENTION

Against the shortcomings in the prior art, an objective of the present invention is to provide a method for orientation growth of ordered quantum dot arrays by utilizing a template.

In order to achieve the aforementioned objective of the present invention, the technical solution adopted for the present invention is as follows:

a knife holder and base system for a milling machine comprises a knife holder provided with a fixed part and a base provided with an inner hole; and the fixed part penetrates the inner hole and is matched with a thread in the fixed part through a bolt to be used so that the knife holder is fixedly connected with the base.

The base is provided with a V-shaped tensioning surface perpendicular to the inner hole and a V-shaped supporting surface in the direction of the inner hole; the V-shaped supporting surface is divided into two inclined planes through the inner hole; and the knife holder is provided with two V-shaped faying surfaces corresponding to the V-shaped tensioning surface and the V-shaped supporting surface of the base, so that the knife holder is closely attached to the base.

The inner wall of the inner hole of the base is provided with an axial groove rotating along a milling drum, a C-shaped expansion pin is arranged in the groove, and the position of a gap of the C-shaped expansion pin corresponds to the bottom of the groove.

The inner wall of the inner hole of the base is provided with a rubber seal ring, so that the fixed part of the knife holder is closely attached to the inner hole of the base.

The fixed part of the knife holder is provided with a groove for installing a rubber sealing washer.

The inner wall of the inner hole of the base is further provided with a clamping table, and the clamping table divides the inner hole into a fixed chamber for accommodating the fixed part and an accommodating chamber for accommodating a nut.

A rubber tail cover is arranged at the tail of the bolt, so as to prevent foreign matter from entering the bolt.

Compared with the prior art, the knife holder and base system for the milling machine has the advantages that after the knife holder of the knife holder and base system for the milling machine is inserted in the base, more than two V-shaped faying surfaces and the V-shaped supporting surface as transition, the knife holder and the base are tensioned through the tensioning bolt, so that the knife holder and base system is of an integrated structure, and the cutting stress of a knife is transmitted into the base better through the knife holder.

Figure 1:
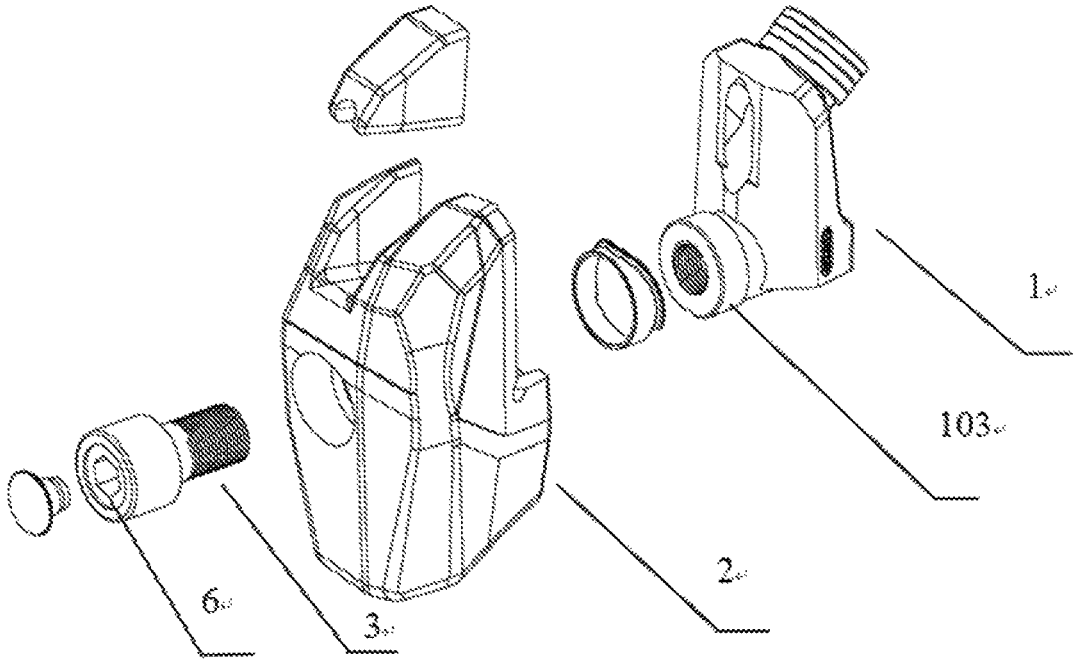
FIG. 1 is a schematic assembly diagram of a knife holder and a base in a typical embodiment of the present invention.
Figure 2:
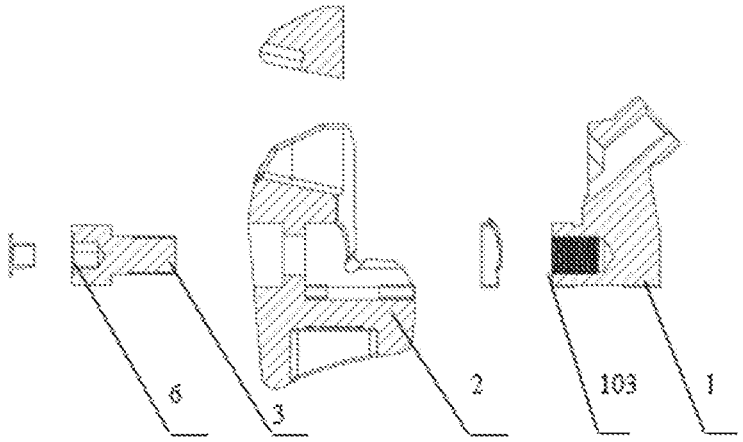
FIG. 2 is a schematic cross-section assembly diagram a knife holder and a base in a typical embodiment of the present invention.
Figure 3:
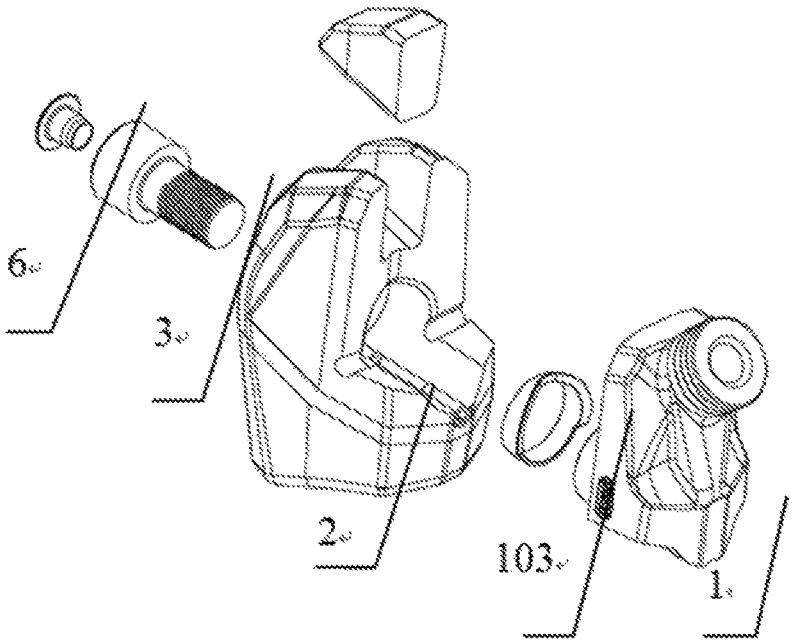
FIG. 3 is a schematic 45-degree assembly diagram of a knife holder and a base in a typical embodiment of the present invention.
Figure 4:
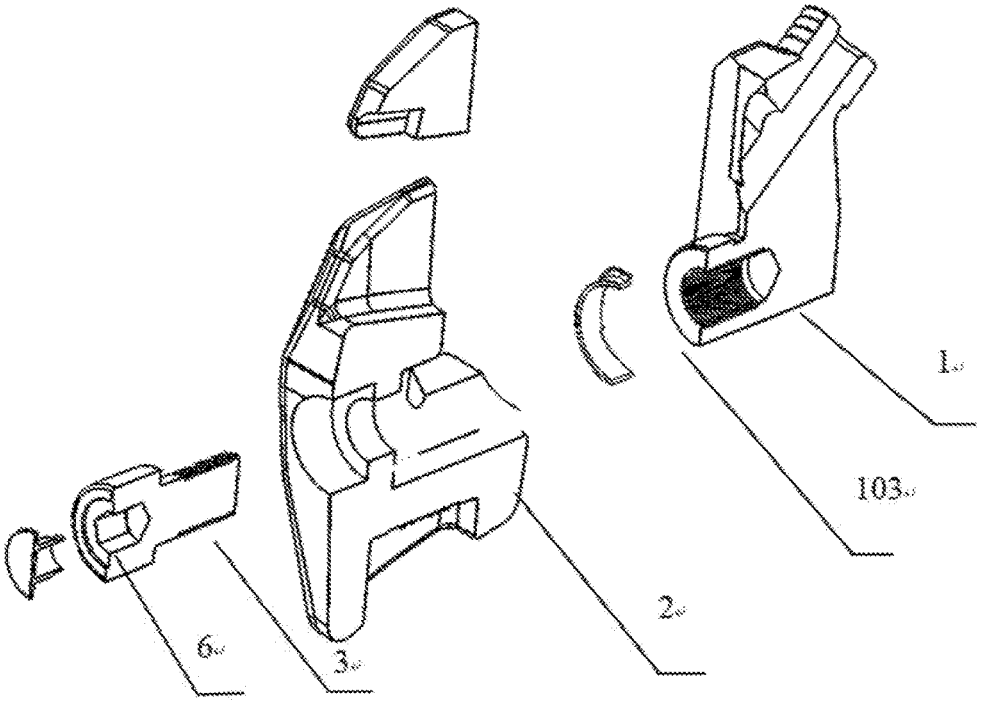
FIG. 4 is a schematic 45-degree cross-section assembly diagram of a knife holder and a base in a typical embodiment of the present invention.
Figure 5:
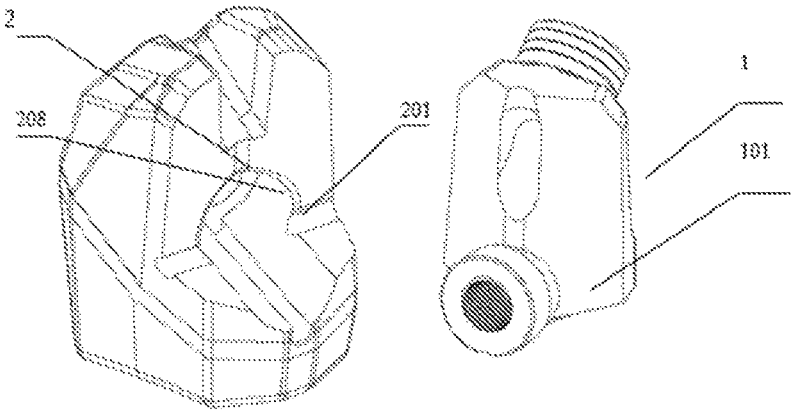
FIG. 5 is a schematic structural diagram of a knife holder and a base in a typical embodiment of the present invention.
Figure 6:
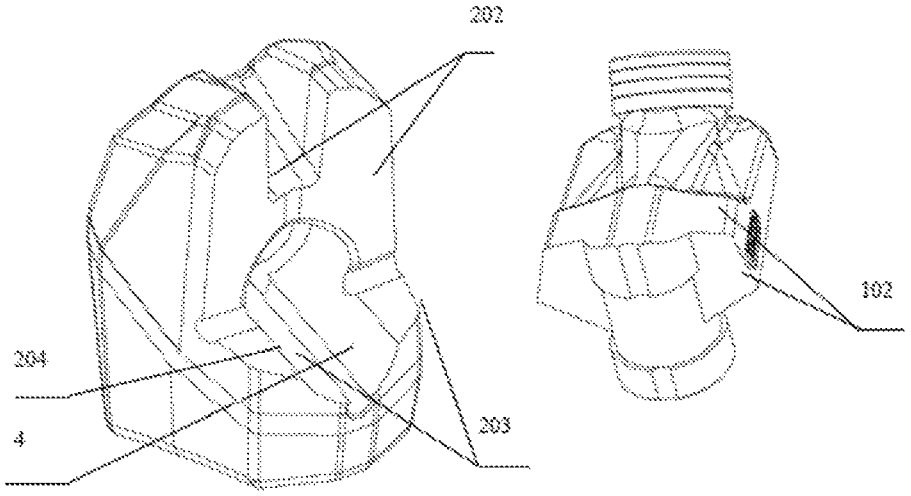
FIG. 6 is a schematic structural diagram of a V-shaped supporting surface and a V-shaped tensioning surface of a base and V-shaped faying surfaces of a knife holder in a typical embodiment of the present invention.
Figure 7:
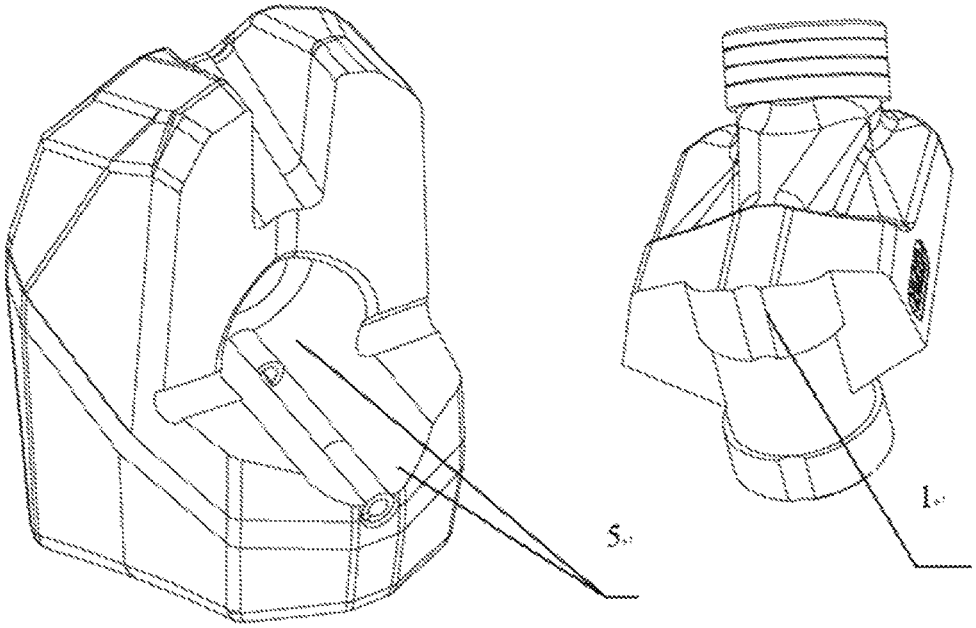
FIG. 7 is a schematic structural diagram of a knife holder and a C-shaped expansion pin in a base in a typical embodiment of the present invention.
Figure 8:
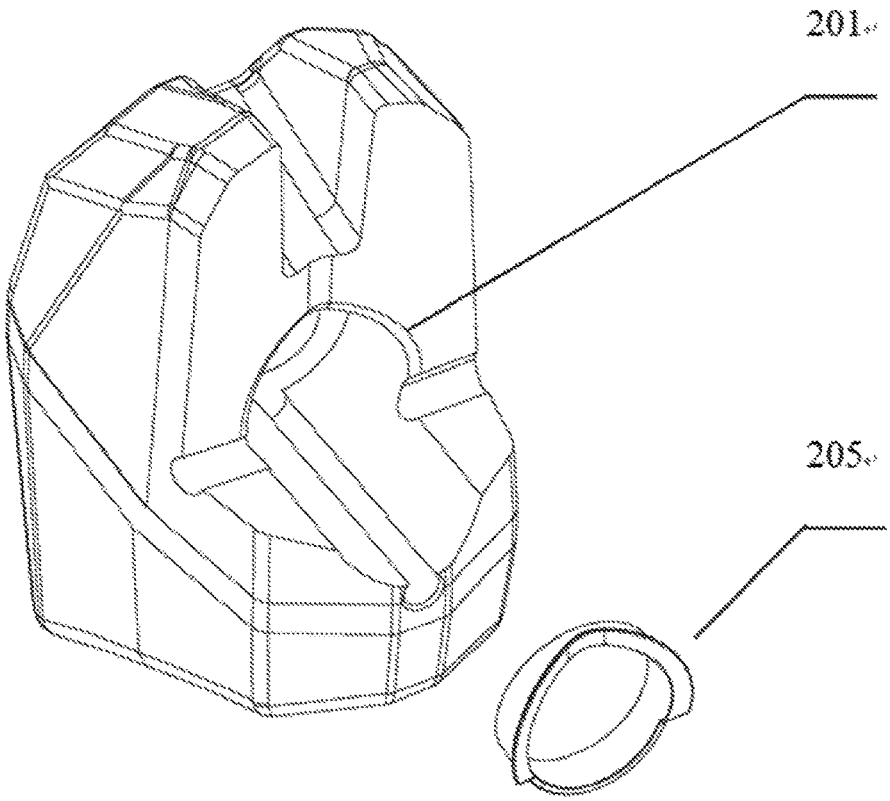
FIG. 8 is a schematic structural diagram of a base and a rubber seal ring in a typical embodiment of the present invention.
Figure 9:
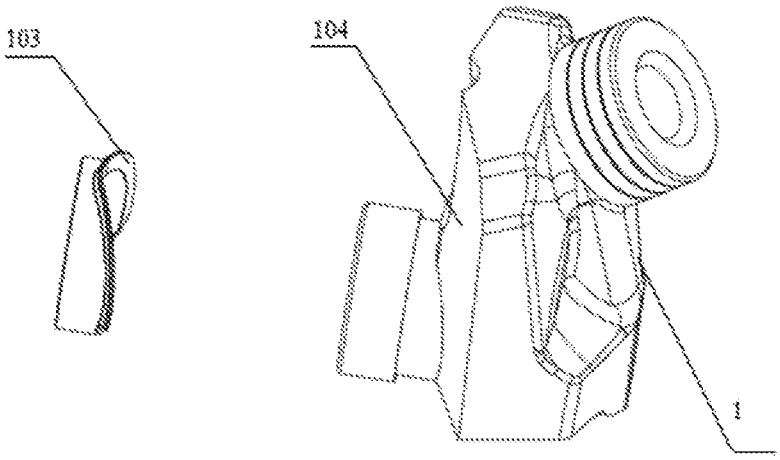
FIG. 9 is a schematic structural diagram of a knife holder and a rubber sealing washer in a typical embodiment of the present invention.
Figure 10:
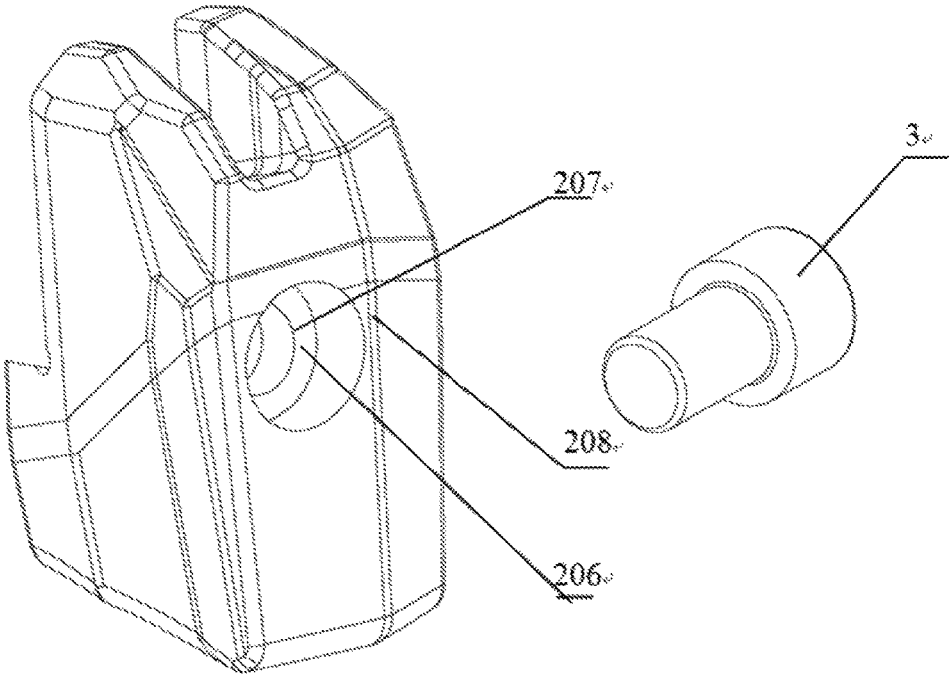
FIG. 10 is a schematic structural diagram of a base and a bolt in a typical embodiment of the present invention.
Figure 11:
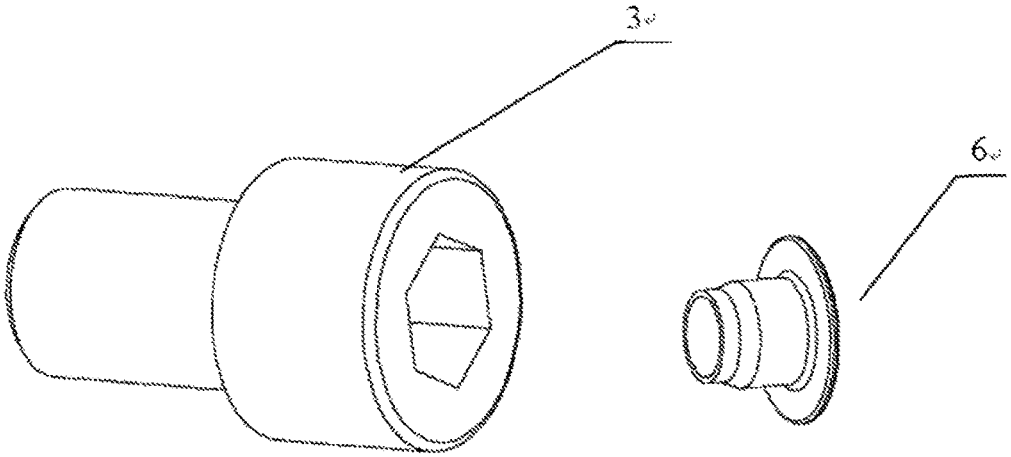
FIG. 11 is a schematic structural diagram of a bolt and a rubber tail cover in a typical embodiment of the present invention.
Figure 12:
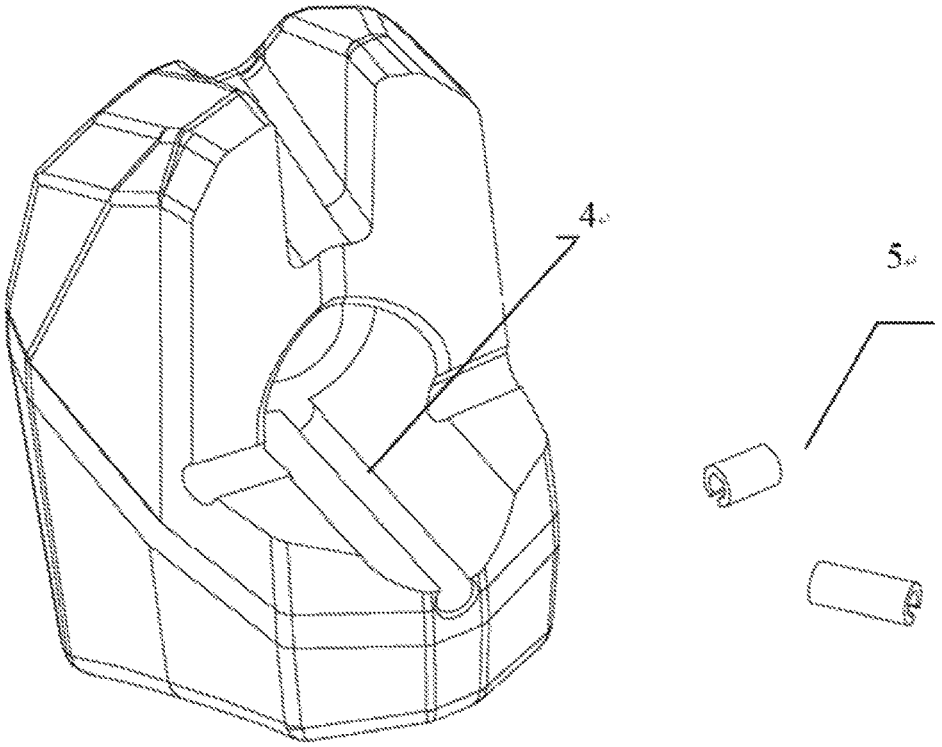
FIG. 12 is a schematic structural diagram of a base and a C-shaped expansion pin in a typical embodiment of the present invention.
Figure 13:
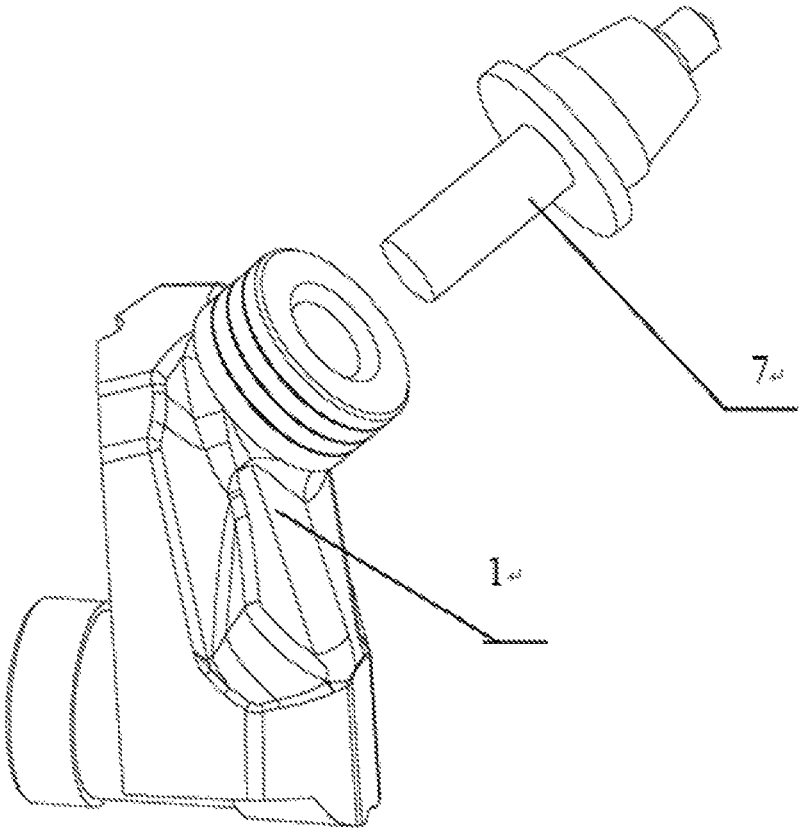
FIG. 13 is a schematic structural diagram of a knife holder and a cutting head in a typical embodiment of the present invention.

DRAWING MARKER DESCRIPTION a knife holder 1, a fixed part 101, a V-shaped faying surface 102, a rubber sealing washer 103, a fixing groove 104, a base 2, an inner hole 201, a V-shaped tensioning surface 202, a V-shaped supporting surface 203, an inclined plane 204, a rubber seal ring 205, a clamping table 206, a fixed chamber 207, an accommodating chamber 208, a bolt 3, a groove 4, a C-shaped expansion pin 5, a rubber tail cover 6 and a cutting head 7.

DETAILED DESCRIPTION OF PREFERRED EMBODIMENTS

In view of the shortcomings in the prior art, the inventor provides the technical solution of the present invention through long-term study and plenty of practice. The technical solution and the implementation process and principle thereof are further described below.

A knife holder and base system for a milling machine comprises a knife holder 1 provided with a fixed part 101 and a base 2 provided with an inner hole 201; and the fixed part 101 penetrates the inner hole 201 and is matched with a thread in the fixed part 101 through a bolt 3 to be used, so that the knife holder 1 is fixedly connected with the base 2.

The base 2 is provided with a V-shaped tensioning surface 202 perpendicular to the inner hole 201 and a V-shaped supporting surface 203 in the direction of the inner hole 201; the V-shaped supporting surface 203 is divided into two inclined planes 204 through the inner hole 201; and the knife holder 1 is provided with two V-shaped faying surfaces 102 corresponding to the V-shaped tensioning surface 202 and the V-shaped supporting surface 203 of the base 2, so that the knife holder 1 is closely attached to the base 2.

The inner wall of the inner hole 201 of the base 2 is provided with an axial groove 4 rotating along a milling drum, a C-shaped expansion pin 5 is arranged in the groove 4, and the position of a gap of the C-shaped expansion pin 5 corresponds to the bottom of the groove 4.

The inner wall of the inner hole 201 of the base 2 is provided with a rubber seal ring 205, so that the fixed part 101 of the knife holder 1 is closely attached to the inner hole 201 of the base 2.

The fixed part 101 of the knife holder 1 is provided with a fixing groove 104 for installing a rubber sealing washer 103.

The inner wall of the inner hole 201 of the base 2 is further provided with a clamping table 206, and the clamping table 206 divides the inner hole into a fixed chamber 207 for accommodating the fixed part 101 and an accommodating chamber 208 for accommodating a nut.

A rubber tail cover 6 is arranged at the tail of the bolt 3, so as to prevent foreign matter from entering the bolt 3.

It should be noted that the drawings in this embodiment are in a very simplified form and are at a non-accurate ratio, and are only used for performing auxiliary description of the embodiment of the present invention conveniently and clearly.

I claim:

1. A knife holder and base system for a milling machine, comprising a knife holder (1) provided with a fixed part (101) and a base (2) provided with an inner hole (201); and the fixed part (101) penetrates the inner hole (201) and is matched with a thread in the fixed part (101) through a bolt (3) to be used, so that the knife holder (1) is fixed connected with the base (2), wherein the base (2) is provided with a V-shaped tensioning surface (202) perpendicular to the inner hole (201) and a V-shaped supporting surface (203) in the direction of the inner hole (201); the V-shaped supporting surface (203) is divided into two inclined planes (204) through the inner hole (201); the bolt (3) comprises a tail; and the knife holder (1) is provided with two V-shaped laminating surfaces (102) corresponding to the V-shaped tensioning surface (202) and the V-shaped supporting surface (203) of the base (2), so that the knife holder (1) is closely attached to the base (2).

2. The knife holder and base system for the milling machine according to claim 1, wherein the fixed part (101) of the knife holder (1) is provided with a fixing groove (104) for installing a rubber sealing washer (103).

3. The knife holder and base system for the milling machine according to claim 1, wherein the inner hole (201) comprises an inner wall, the inner wall of the inner hole (201) of the base (2) is further provided with a clamping table (206), and the clamping table (206) divides the inner hole into a fixed chamber (207) for accommodating the fixed part (101) and an accommodating chamber (208) for accommodating a nut.

4. The knife holder and base system for the milling machine according to claim 1, wherein a rubber tail cover (6) is arranged at the tail of the bolt (3), so as to prevent foreign matter from entering the bolt (3).

5. A knife holder and base system for a milling machine, comprising a knife holder (1) provided with a fixed part (101) and a base (2) provided with an inner hole (201); and the fixed part (101) penetrates the inner hole (201) and is matched with a thread in the fixed part (101) through a bolt (3) to be used, so that the knife holder (1) is fixed connected with the base (2), wherein the inner hole (201) comprises an inner wall, the inner wall of the inner hole (201) of the base (2) is provided with an axial groove (4), a C-shaped expansion pin (5) is arranged in the groove (4), and the position of a gap of the C-shaped expansion pin (5) corresponds to the bottom of the groove (4).

6. A knife holder and base system for a milling machine, comprising a knife holder (1) provided with a fixed part (101) and a base (2) provided with an inner hole (201); and the fixed part (101) penetrates the inner hole (201) and is matched with a thread in the fixed part (101) through a bolt (3) to be used, so that the knife holder (1) is fixed connected with the base (2), wherein the inner hole (201) comprises an inner wall, and the inner wall of the inner hole (201) of the base (2) is provided with a rubber seal ring (205), so that the fixed part (101) of the knife holder (1) is closely attached to the inner hole (201) of the base (2).

* * * * *